US006398591B1

(12) United States Patent
Hess et al.

(10) Patent No.: US 6,398,591 B1
(45) Date of Patent: Jun. 4, 2002

(54) MODULAR JACK FOR TUBULAR ENCLOSURES

(75) Inventors: John Matthew Hess, Dallastown; Ronald P. Locati, York; Jason R. Cartwright, Dallastown; Jeffrey Wallace Fleming, York, all of PA (US)

(73) Assignee: Stewart Connector Systems, Inc., Glen Rock, PA (US)

( * ) Notice: Subject to any disclaimer, the term of this patent is extended or adjusted under 35 U.S.C. 154(b) by 0 days.

(21) Appl. No.: 09/299,898

(22) Filed: Apr. 27, 1999

Related U.S. Application Data

(60) Provisional application No. 60/085,156, filed on May 12, 1998.

(51) Int. Cl.[7] ..... H01R 24/00
(52) U.S. Cl. ..... 439/676; 439/79; 439/606
(58) Field of Search ..... 439/676, 79, 80, 439/606, 608, 695, 930, 948

(56) References Cited

U.S. PATENT DOCUMENTS

| | | | | | |
|---|---|---|---|---|---|
| 4,854,881 | A | * | 8/1989 | Ditzig | 439/26 |
| 5,364,294 | A | * | 11/1994 | Hatch et al. | 439/676 |
| 5,498,179 | A | | 3/1996 | Byczek | 439/843 |
| 5,573,412 | A | | 11/1996 | Anthony | 439/133 |
| 5,618,200 | A | | 4/1997 | Norgaard | 439/427 |
| D387,729 | S | | 12/1997 | Huska | |
| 5,700,160 | A | | 12/1997 | Lee | 439/578 |
| 5,766,043 | A | * | 6/1998 | Talend | 439/676 |
| 5,803,770 | A | * | 9/1998 | Swendson et al. | 439/676 |
| 5,971,805 | A | * | 10/1999 | Belopolsky et al. | 439/620 |

OTHER PUBLICATIONS

Hawley's Condensed Chemical Dictionary, 1997, pp. 371.*
Webster's New World Dicitonary, Third Edition, pp. 1459.*

* cited by examiner

*Primary Examiner*—Lincoln Donovan
*Assistant Examiner*—Kyung S. Lee
(74) *Attorney, Agent, or Firm*—Steinberg & Raskin, P.C.

(57) ABSTRACT

A modular jack for tubular enclosures including an elongate housing formed of dielectric material having a front end, a rear end and a body extending longitudinally between the front and rear ends, at least a portion of the body having a longitudinally extending cylindrical outer surface defining an outer cylindrical boundary envelope of the jack. The body includes a forward body portion adjacent the front end having a longitudinally extending side wall with outer and inner surfaces and a rearward body portion adjacent the rear end having an outer surface. The inner surfaces define a plug-receiving receptacle. The jack also includes a plurality of elongate contact/terminal members formed of conductive material, each contact/terminal member including a contact portion extending through the plug-receiving receptacle, a terminal portion mounted in the rearward body, and an intermediate bridging portion. The contact/terminal members are in their entirety recessed inwardly within the outer cylindrical boundary envelope of the jack.

14 Claims, 12 Drawing Sheets

6
20
77
72
82
48b
48b
48b
48b
26
40
42
46
46
32
24
6
18

20
72
72
82
48
48
86
86
26
52
52
50
50
24
52
44
52
46
32
18

FIG.8
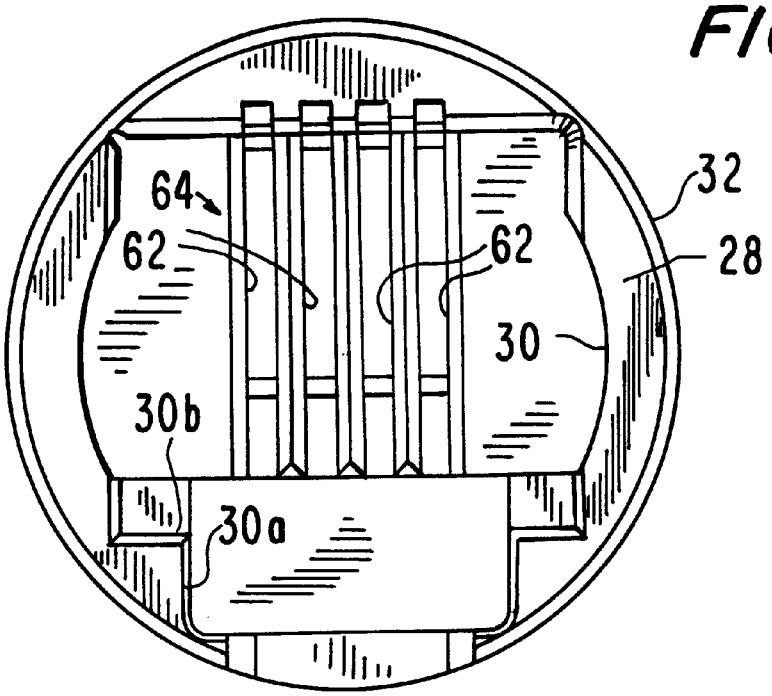
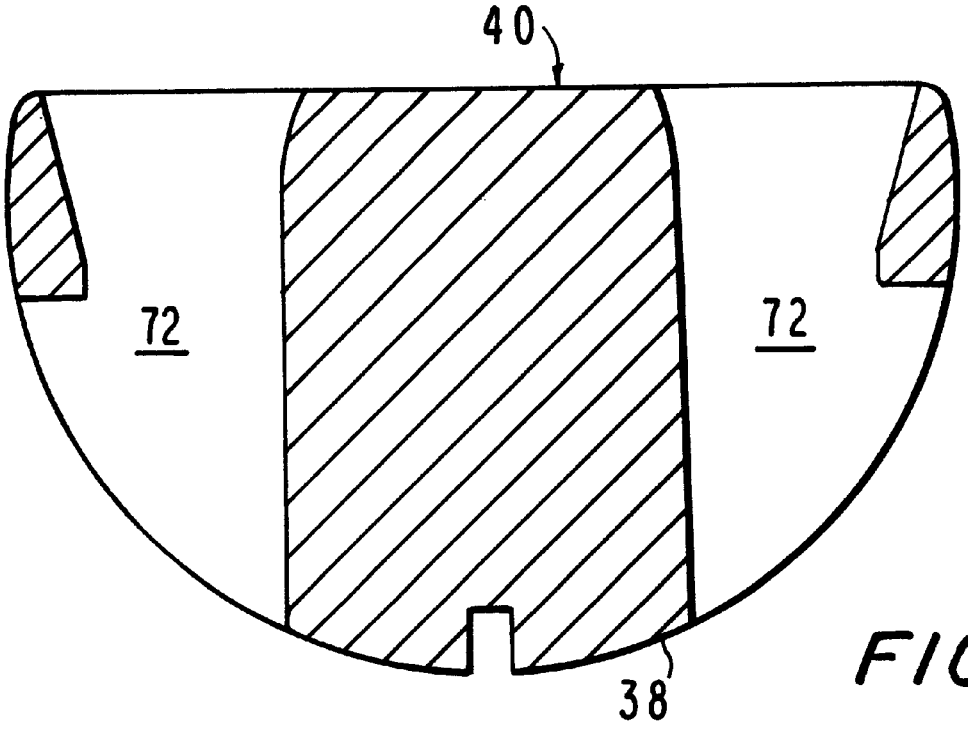
FIG.9

MODULAR JACK FOR TUBULAR ENCLOSURES

CROSS-REFERENCE TO RELATED APPLICATION

This application claims priority under 35 U.S.C. §119(e) of U.S. provisional patent application Ser. No. 60/085,156 filed May 12, 1998.

FIELD OF THE INVENTION

This invention relates generally to electrical connectors and, more particularly, to modular jacks for mounting in tubular enclosures.

BACKGROUND OF THE INVENTION

The use of modular connectors, i.e., plugs and jacks, in data communications applications has become common. Since the structure and dimensions of modular connectors have become standardized and since the mating and disengagement of modular plugs and modular jacks are simple and familiar to most individuals, the use of modular connectors is especially suited to data communication applications where interchangeability or detachability of components is desirable.

A need has arisen to provide small diameter tubular components with modular connectability. For example, in one arrangement of bar code scanning equipment, a pencil-shaped optical wand is utilized by an operator, such as a supermarket clerk, to scan bar codes on food items being purchased. Electrical signals generated by opto-electrical circuitry within the wand are transmitted to a processing unit through a flexible cable that connects the wand to the processing unit. It is desirable to connect the cable to the wand by means of a modular connector in order to enable and facilitate detachment of the wand from the cable for servicing or for replacement by other equipment having the same modular connectability.

On the other hand, the space available within a small diameter tubular component, such as a bar code scanning wand, is limited and a standard housing and contact configuration of modular connectors is not general amenable for use in such small tubular enclosures.

OBJECTS AND SUMMARY OF THE INVENTION

Accordingly, it is an object of the present invention to provide new and improved modular connectors.

Another object of the present invention is to provide new and improved modular jacks for mounting in tubular enclosures.

Still another object of the present invention is to provide new and improved modular jacks designed to allow mating with FCC standard modular plugs for mounting in wands used for scanning bar codes.

Briefly, in accordance with the present invention, these and other objects are obtained by providing a modular jack comprising an elongate housing formed of dielectric material having a longitudinally extending body, at least a portion of which has a longitudinally extending cylindrical outer surface which defines an outer cylindrical boundary envelope. The housing body includes a forward body portion in which a plug-receiving receptacle is defined. A plurality of elongate contact/terminal members formed of conductive material is mounted in the housing, each of the contact/terminal members including a contact portion extending through the plug-receiving receptacle, a terminal portion mounted in a rearward body portion and an intermediate bridging portion extending over a planar surface segment which is recessed inwardly within the outer cylindrical boundary envelope of the jack.

DESCRIPTION OF THE DRAWINGS

A more complete appreciation of the present invention and many of the attendant advantages thereof will be readily understood by reference to the following detailed description when considered in connection with the accompanying drawings in which:

FIG. 8 is a front elevation view of the jack housing shown in FIG. 3;

FIG. 9 is a section view of the housing shown in FIG. 3 taken along line 9—9 of FIG. 7;

DETAILED DESCRIPTION OF THE PREFERRED EMBODIMENT

Figure 1:
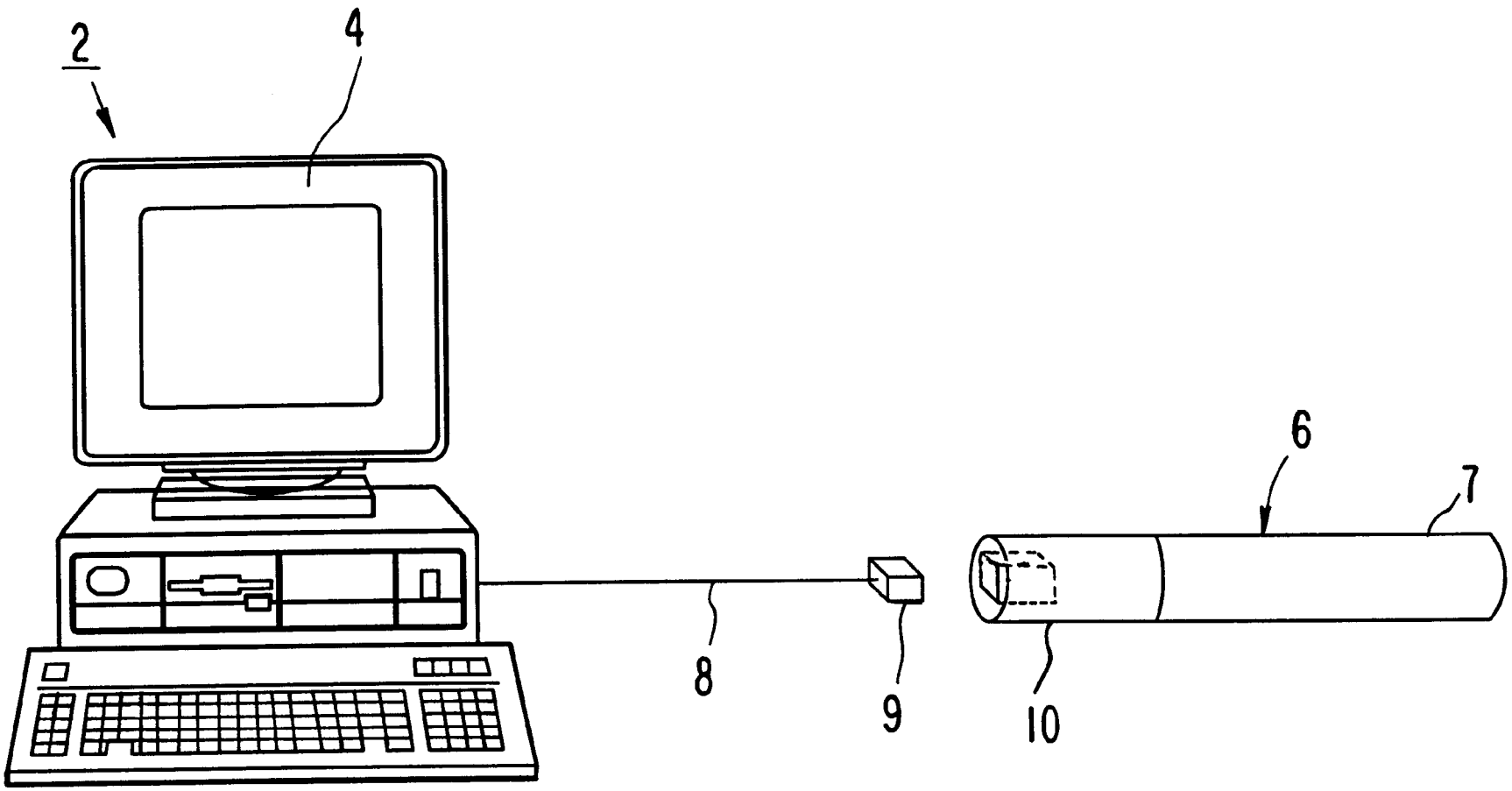
FIG. 1 is a schematic view of bar code scanning equipment utilizing a modular jack in accordance with the present invention.

Referring now to the drawings wherein like reference characters designate identical or corresponding parts throughout the several views, and more particularly to FIG. 1, a typical application of a modular jack in accordance with the present invention is illustrated schematically in the form of bar code scanning equipment 2 including a wand 6 having a tubular housing 7 having an inner diameter of about 0.5 inches which defines a tubular enclosure for a jack 10. The jack 10 is mounted on a printed circuit board which is coupled to opto-electronic circuitry within the wand. The wand 6 is detachably connected to data processing equipment 4 by means of a flexible cable 8 terminated by a modular plug 9.

A jack 10 in accordance with the invention comprises an elongate unitary housing 12, four elongate jack contact/terminal members 14 and a grounding contact/terminal member 16. Housing 12 is formed of dielectric material, such as glass-filled polyester and has front end 18, a rear end 20, a forward body portion 24 adjacent front end 18 and a rearward body portion 26 adjacent rear end 20.

Figure 6:
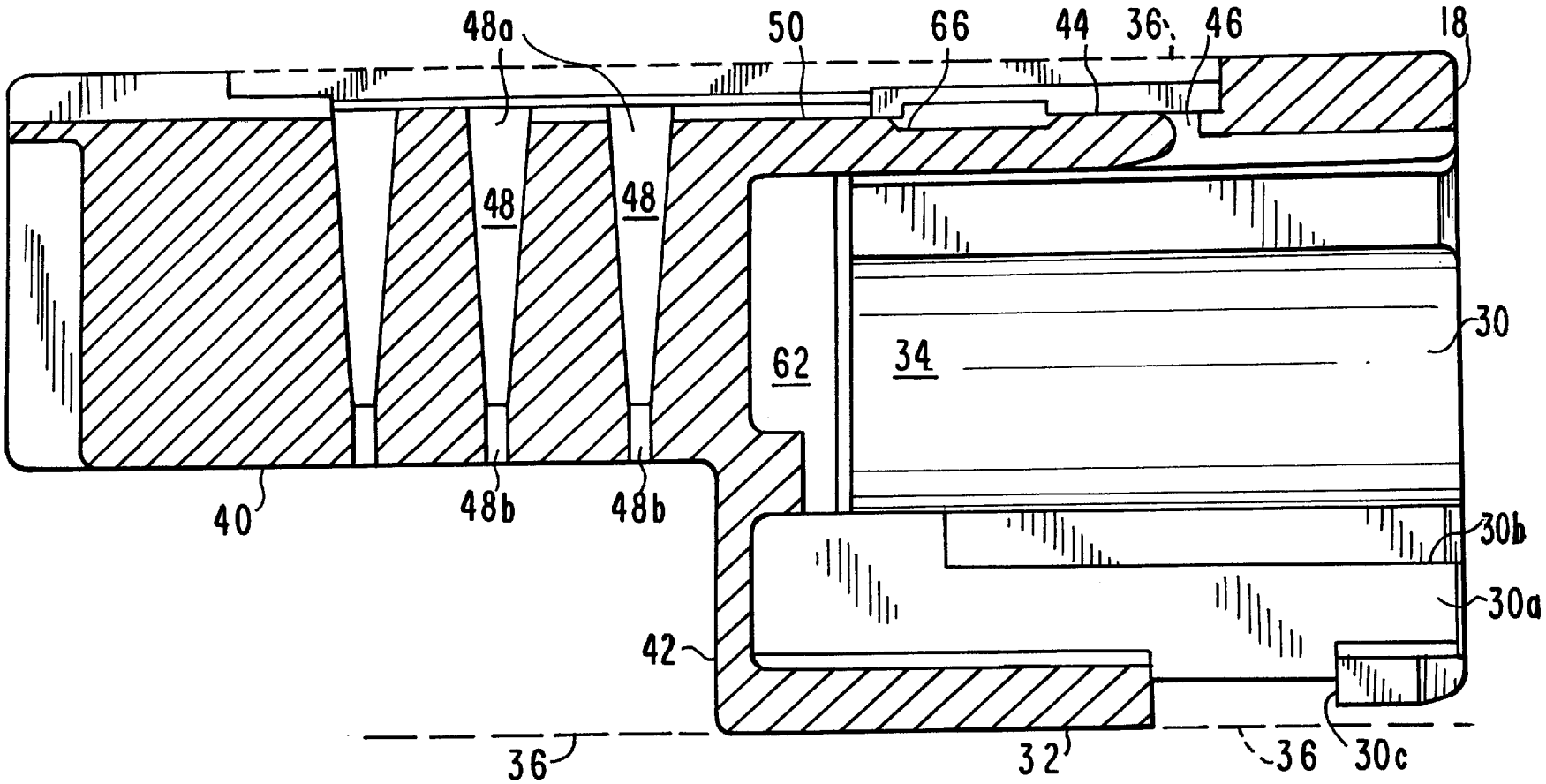
FIG. 6 is a section view of the housing shown in FIG. 2 taken along line 6—6 of FIG. 5.
Figure 7:
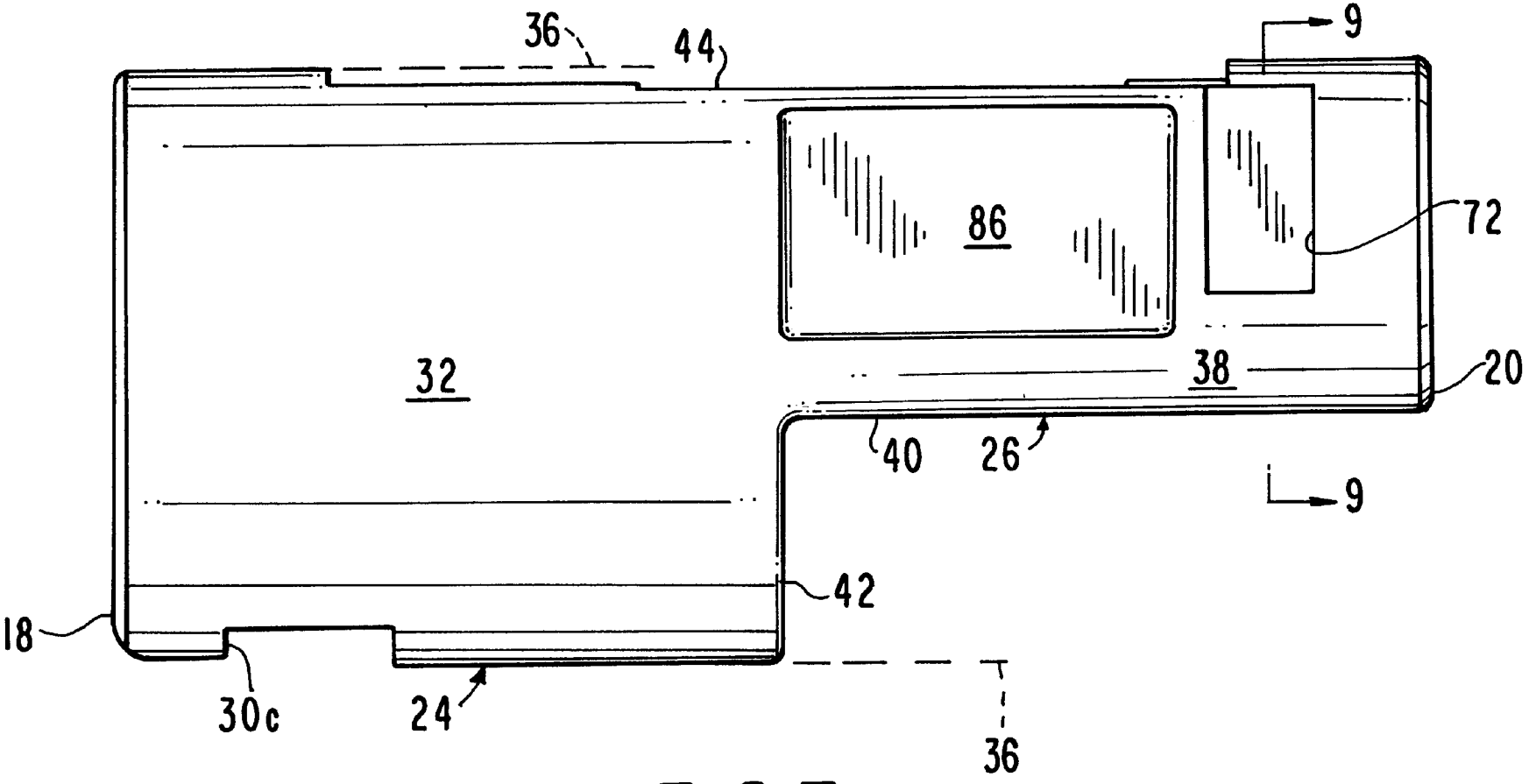
FIG. 7 is a side elevation view of the housing illustrated in FIG. 3.
Figure 10:
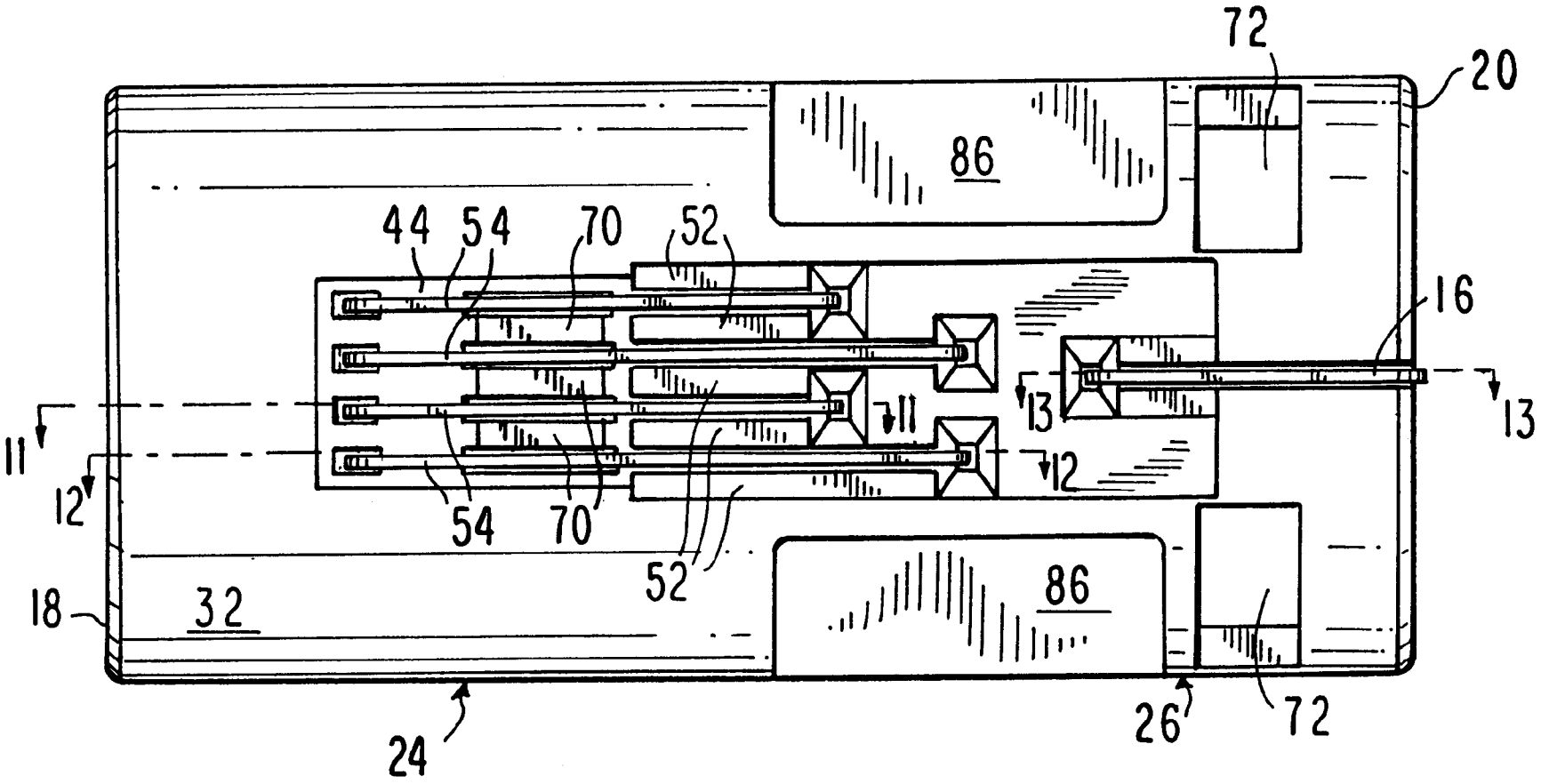
FIG. 10 is a top plan view of the jack shown in FIG. 2.

The forward body portion 24 includes a longitudinally extending side wall 28 having inner surfaces 30 and a longitudinal extending cylindrical outer surface 32. The inner surfaces 30 of side wall 28 define a plug-receiving receptacle 34 structured with guide surfaces 30*a*, 30*b* and latch surfaces 30*c* of standard configuration to receive a standard 4-position modular plug, such as a modular plug 9 (FIG. 1). The cylindrical outer surface 32 of side wall 28 has a diameter slightly smaller than the inner diameter of the tubular enclosure into which the jack 10 is received and defines an outer cylindrical boundary envelope 36 (FIGS. 6 and 7). As described below, it is a feature of the jack of the present invention that the jack contact/terminal members are situated in their entirety recessed inwardly within the outer cylindrical boundary envelope 36.

Rearward body portion 26 comprises a solid semi-cylindrical portion having a substantially planar surface 40 and an outer semi-cylindrical surface segment 38 that is coextensive with the outer cylindrical surface 32 of side wall 28 of forward body portion 24. Planar surface 40 terminates at a forward end thereof at a substantially planar rearward end surface segment 42 of the forward body portion 24.

A longitudinally extending recessed planar surface segment 44 is formed at a top region of the coextensive outer cylindrical surfaces 32, 38 of the forward and rearward body portions 24, 26. The planar surface segment 44 is recessed inwardly within the outer cylindrical boundary envelope 36 of jack 10. Four equally spaced openings 46 are formed through the side wall 28 of the forward body portion 24 at a front-end region of the recessed planar surface segment 44, each opening 46 extending between the recessed planar surface segment 44 and the inner surface 30 of sidewall 28 defining the plug-receiving receptacle 34. Four tapered bores 48 are situated in longitudinal alignment with the four openings 46 and in two separate rows are formed through the rearward body portion 26 at a rearward end region of the recessed planar surface segment 44. Each bore 48 extends through the rearward body portion, opening at one end 48*a* at the recessed planar surface segment 44 and at the other end at the planar surface segment 40 of the rearward body portion 26.

Four longitudinally extending channels 50 are formed on a recessed planar surface segment 44 at least partly by means of longitudinally extending shoulders 52. Each channel extends between a respective one of the openings 46 formed through the side wall 28 of the forward body portion 24 and an opening 48*a* of a respective one of the bores 48 formed through the rearward body portion 26.

Figure 11:
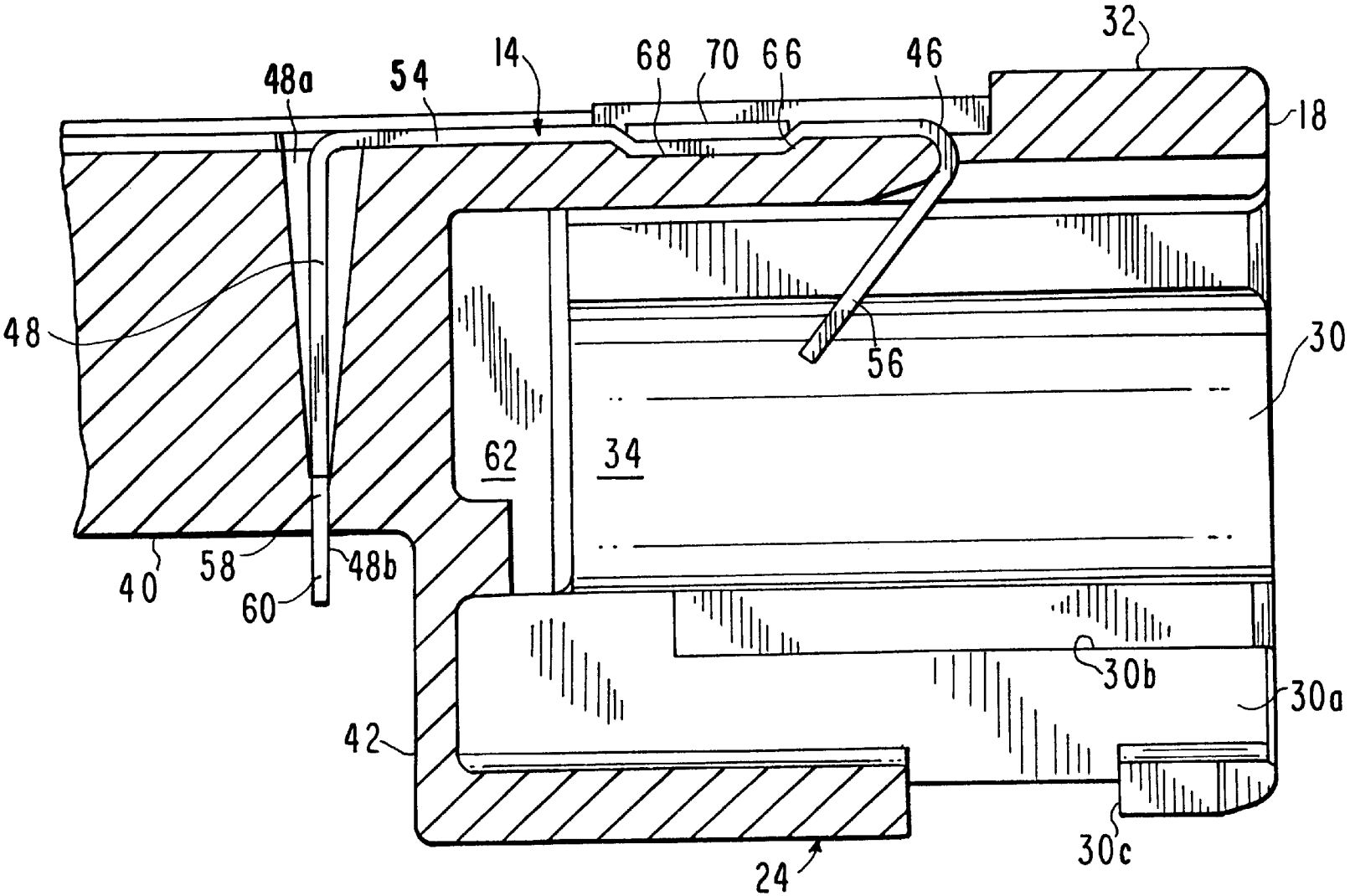
FIG. 11 is a fragmentary section view of the jack shown in FIG. 2 taken along line 11—11 of FIG. 10.
Figure 12:
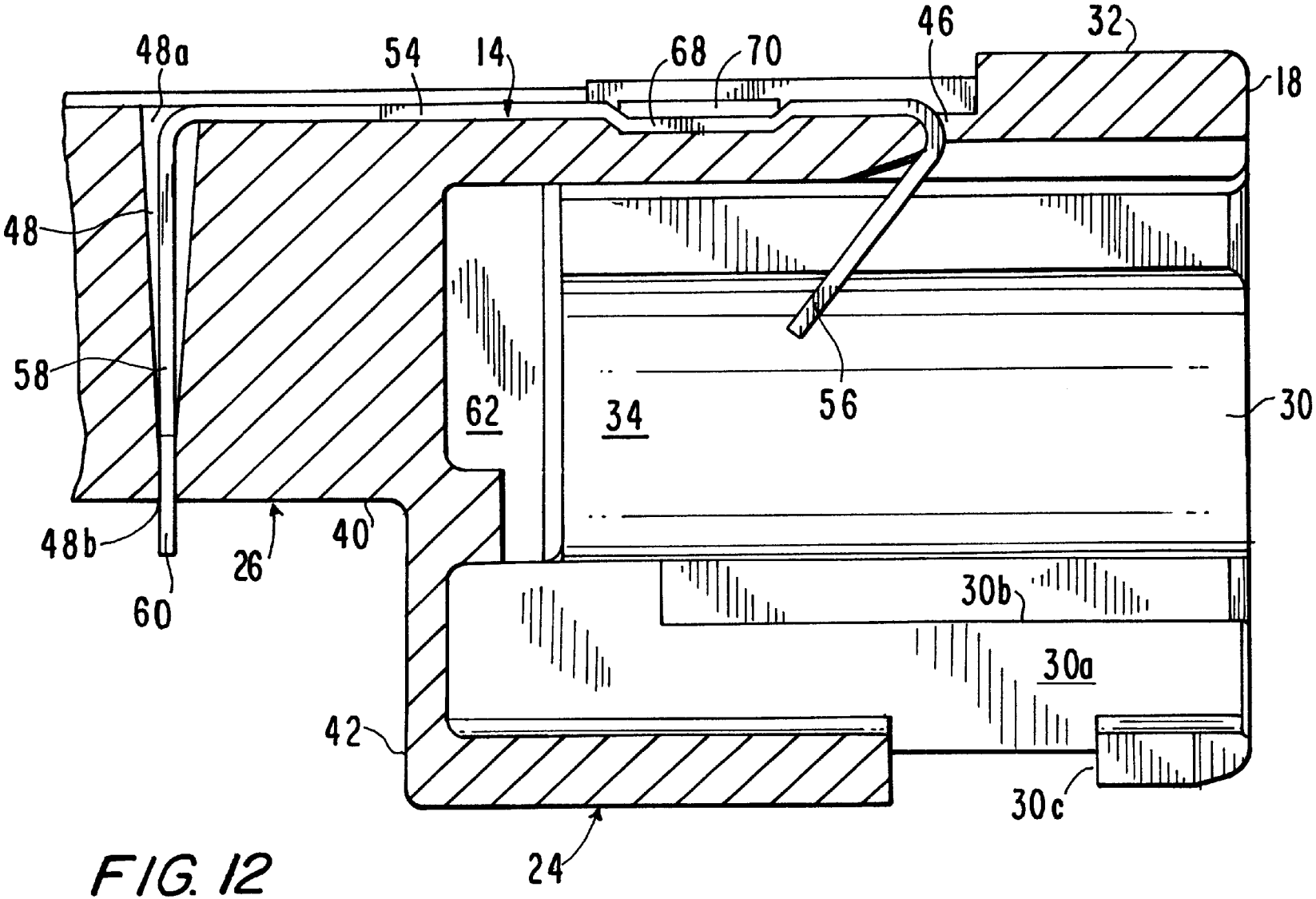
FIG. 12 is a fragmentary section view of the jack shown in FIG. 2 taken along line 12—12 of FIG. 10.

Jack 10 further comprises four elongate jack contact/terminal members 14 formed from conductive material. Each jack contact/terninal members 14 includes an intermediate bridging portion 54 that extends longitudinally over the recessed planar surface segment 44 in a respective one of the channels 50 between a respective one of the openings 46 and the end opening 48*a* of a respective one of the tapered bores 48, a contact portion 56 extending from the forward end of the bridging portion 54 to the respective opening 46 and into the plug-receiving receptacle 34, and a terminal portion 58 extending from the rearward end of the bridging portion 54 through the end opening 48*a* of the respective tapered bore 48 and through the bore 48 (FIGS. 11 and 12). The terminal portion 58 exists from bore 48 through end opening 48*b* and a terminal pin portion 60 of terminal portion 58 projects beyond the planar surface 40 of the rearward body portion 26.

Each contact portion 56 extends obliquely through the plug-receiving receptacle 34 from a respective opening 46 into a respective vertical guide slot 62 of a plurality of such guide slots defined in a comb structure 64 formed at the rearward end of the plug-receiving receptacle 34 (FIG. 8). The slots 62 serve to receive and guide the respective contact portion 56 as the jack is engaged by a mating modular plug.

A short longitudinal notch 66 is formed in each channel 50 on the recessed planar surface segment 44, and a corresponding short segment 68 of each of the intermediate bridging portions 54 of contact/terminal members 14 is offset with respect to the major length of that bridging portion (FIGS. 11 and 12). The offset segment 68 of the intermediate bridging portion 54 of each jack contact/terminal member 14 is received in a corresponding longitudinal notch 66 of a respective channel 50 so that the offset segment of the contact/terminal member is recessed below the recessed planar surface segment 44. An upstanding staking ridge 70 of housing material is situated between adjacent recesses 66 so that when the jack contact/terminal members 14 are positioned on housing 12, the intermediate bridging portions 54 of each contact/terminal member can be heat staked in place at the offset segments 68 without risking the possibility that the heat staking material will project beyond the outer cylindrical boundary envelope 36.

Figure 2:
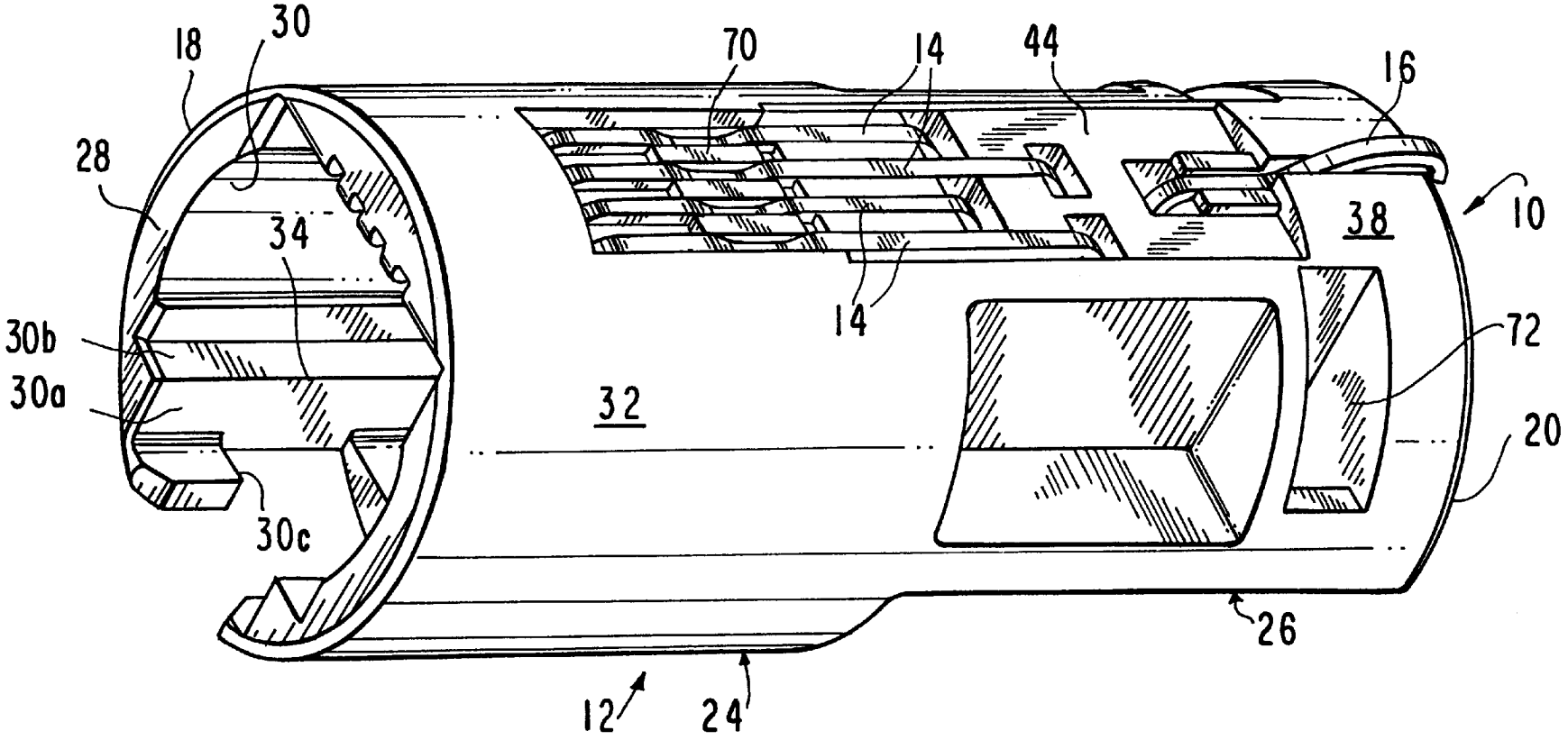
FIG. 2 is a perspective view of a modular jack in accordance with the present invention.
Figure 3:
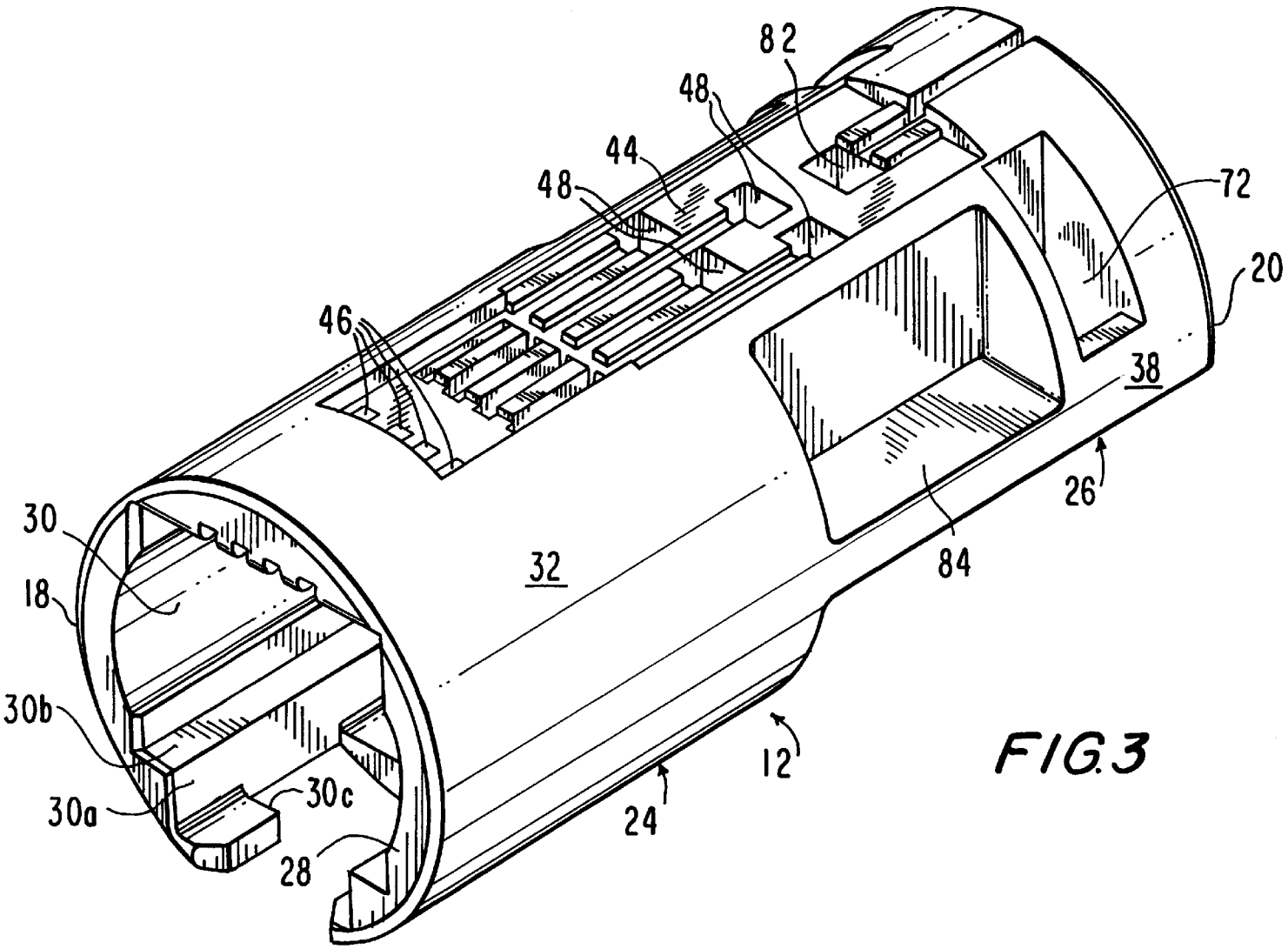
FIG. 3 is a perspective view of the housing of the modular jack shown in FIG. 2.
Figure 5:
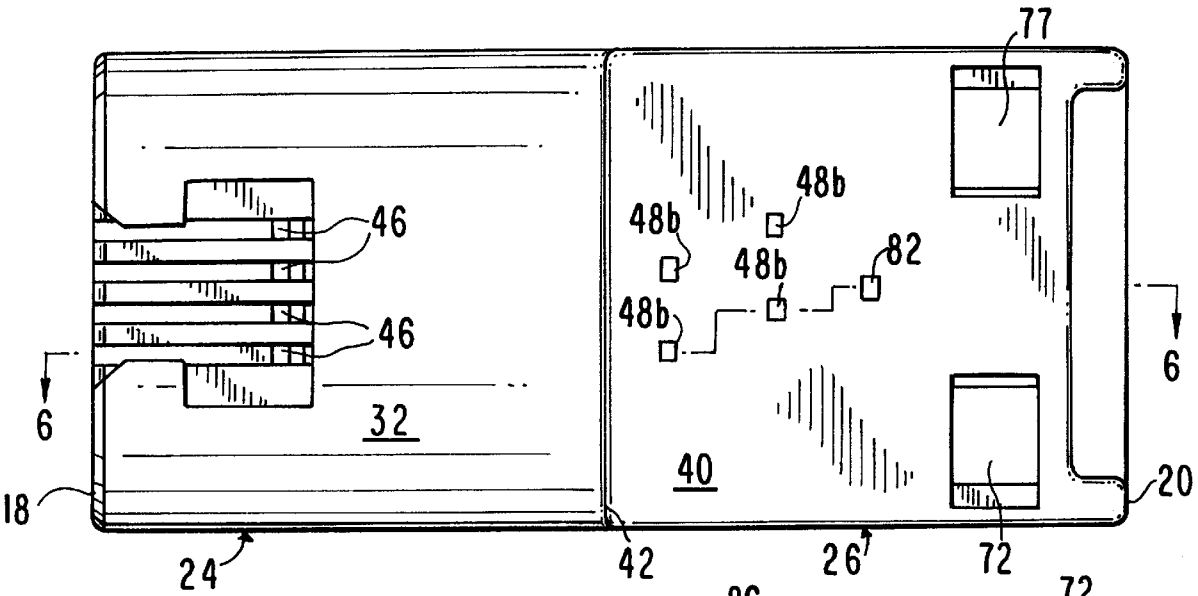
FIG. 5 is a bottom plan view of the housing shown in FIG. 2.
Figure 4:
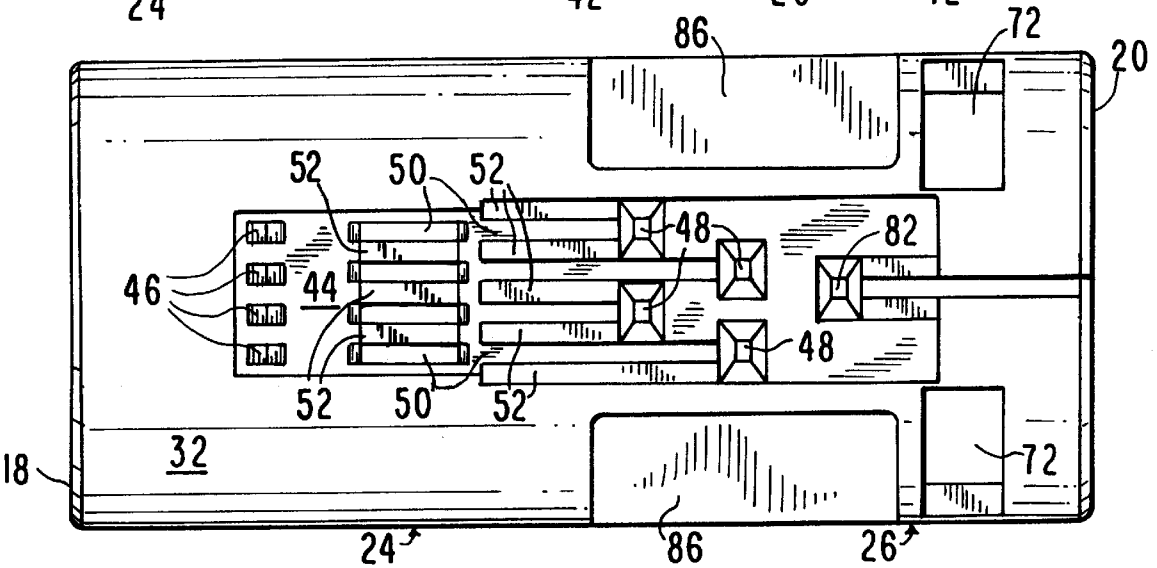
FIG. 4 is a top plan view of the housing illustrated in FIG. 3.

A pair of cavities 72 are formed in the outer peripheral semi-cylindrical surface segment 38 of the rearward body portion 26 (FIG. 2). Each cavity 72 is structured and arranged to cooperate with a member (not shown) that projects inwardly within the tubular enclosure for purposes of locating the jack within the enclosure.

Figure 13:
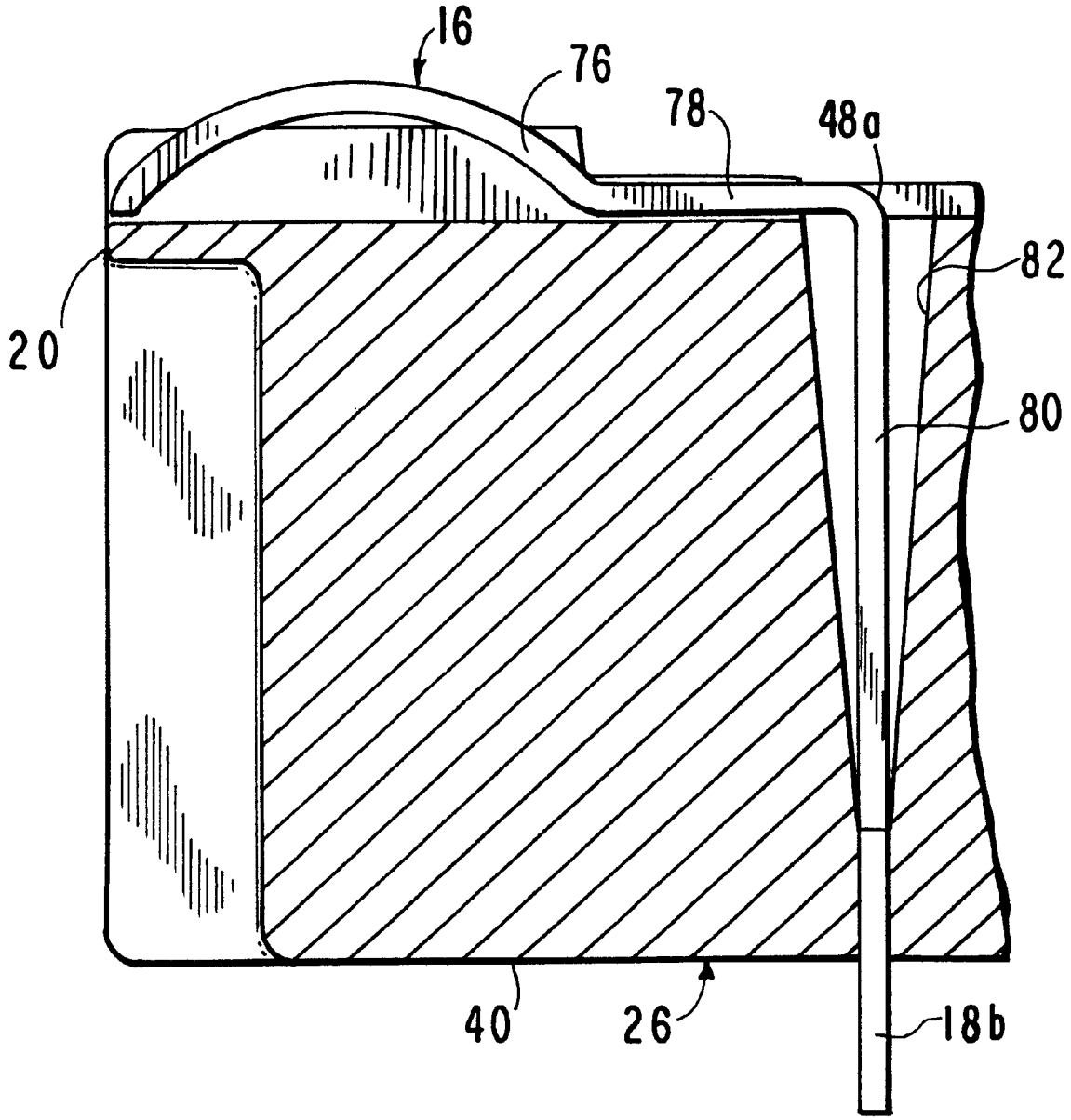
FIG. 13 is a fragmentary section view of the jack shown in FIG. 2 taken along line 13—13 of FIG. 10.

The jack 10 further includes a grounding contact/terminal member 16 which is mounted at a rear top region of the rearward body portion 26 of housing 12. The grounding terminal/contact member 16 is arranged at the rearward body portion 26 and structured to engage the interior surface of the tubular enclosure in which the jack 10 is situated. Referring to FIG. 13, the grounding contact/terminal member 16 includes a grounding contact portion 76, an intermediate grounding bridging portion 78 and a grounding terminal portion 80. The grounding terminal portion 80 extends from one end of the grounding bridging portion 78 and through a grounding terminal bore 82 formed through the rearward portion 26 to project beyond the planar surface 40 of the rearward body portion 26. As seen in FIG. 13, the grounding contact portion 76 flexibly extends from another end from the grounding bridging portion 78 and is situated in a first position outwardly of the outer cylindrical boundary envelope 36 prior to the jack 10 being situated in the tubular wand 6. The grounding contact portion 76 is adapted to engage an interior surface of the tubular enclosure when the jack 10 is situated therein and to flex to a second position situated within the cylindrical boundary envelope 36 when the insertion is completed.

Figure 14:
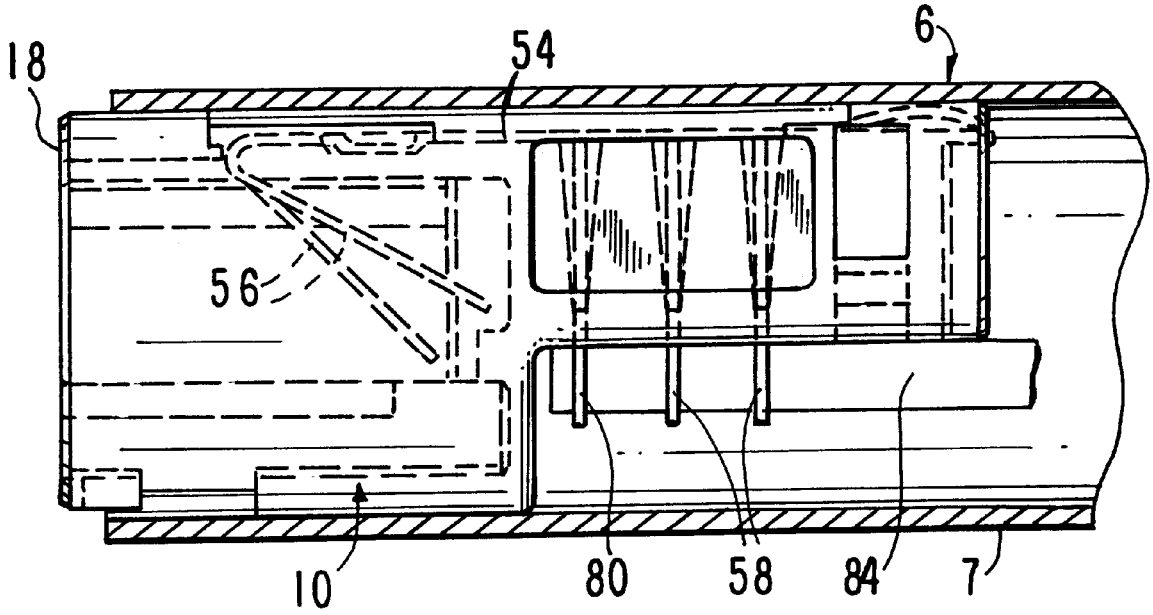
FIG. 14 is a partial section view of a jack in accordance with the present invention shown mounted within a tubular enclosure and connected to a printed circuit board.

In one application of the jack 10, the terminal pin portion 60 of the jack contact/terminals 14 are electrically connected to a circuit of a printed circuit board 84 situated in the tubular enclosure (FIG. 14). Further, the portion of the grounding terminal portion 80 of the grounding contact/terminal member 16 which extends beyond the planar surface 40 is electrically connected to a grounding region of the printed circuit board 84. The terminal pin portion 60 of the jack contact/terminals 14 as well as the portion of the grounding terminal portion 80 of the grounding contact/terminal member 16 which extends beyond the planar surface 40 may be electrically connected to other electrical components instead of a printed circuit board.

Lastly, core cavities 86 are provided in the rearward body portion 26 on each side of the housing 12 and serve to reduce the amount of dielectric material required to fabricate the housing 12. Core cavities 86 are formed during the manufacture of the housing 12, which is by injection molding, so as to avoid a thick dielectric part and thus problems with shrinkage of the dielectric material during cooling thereof after molding of the housing.

Obviously, numerous modifications and variations of the present invention are possible in light of the above teachings. Accordingly, it is understood that other embodiments of the invention are possible in the light of the above teachings.

We claim:

1. A modular jack for tubular enclosures, comprising:

a unitary elongated housing formed of dielectric material having a front end, a rear end and a body extending longitudinally between said front and rear ends, at least a portion of said body having a longitudinally extending cylindrical outer surface defining an outer cylindrical boundary envelope of said jack, said body including a forward body portion adjacent said front end having a longitudinally extending side wall with outer and inner surfaces, said inner surfaces defining a plug-receiving receptacle, and a rearward body portion adjacent said rear end having an outer surface, wherein a longitudinally extending planar surface segment is formed in said outer cylindrical surface of said body of said housing, said planar surface segment being recessed inwardly within said outer cylindrical boundary envelope of said jack; and a plurality of elongated contact/terminal members formed of conductive material, each of said contact/terminal members including a contact portion extending through said plug-receiving receptacle, a terminal portion mounted in said rearward body portion, and an intermediate bridging portion situated on said recessed planar surface segment and inwardly within said outer cylindrical envelope of said jack, said contact/terminal members being in their entirety recessed inwardly within said outer cylindrical boundary envelope of said jack.

2. A modular jack as recited in claim 1, wherein said longitudinally extending cylindrical outer surface comprises said outer surface of said side wall of said forward body of said jack housing.

3. A modular jack as recited in claim 2, wherein said rearward body portion is semi-cylindrical having an outer surface segment coextensive with said outer surface of said side wall of said forward body portion.

4. A modular jack as recited in claim 3, wherein said rearward body portion comprises a solid semi-cylindrical portion.

5. A modular jack for tubular enclosures, comprising:

an elongated unitary housing formed of dielectric material having a front end, a rear end and a body longitudinally extending between said front and rear ends, said body including a. a forward body portion adjacent said front end including a longitudinally extending side wall having inner and outer surfaces, said inner surfaces defining a plug-receiving receptacle and said outer surface comprising a longitudinally extending cylindrical outer surface defining an outer cylindrical boundary envelope of said jack;

b. a rearward body portion adjacent said rear end comprising a solid semicylindrical cylindrical portion having an outer surface segment coextensive with said outer surface of said side wall of said forward body portion, and a planar surface;

c. a longitudinally extending planar surface segment being formed in said coextensive outer cylindrical surfaces of said forward and rearward body portions of said housing, said planar surface segment being recessed inwardly within said outer cylindrical boundary envelope of said jack;

d. a plurality of openings formed through said side wall of said forward body portion at a forward end region of said recessed planar surface segment, each opening extending between said recessed planar surface segment and said plug-receiving receptacles;

e. a plurality of bores formed through said rearward body portion at a rearward end region of said recessed planar surface segment, each bore extending through said rearward body portion, opening at one end at said recessed planar surface segment and at another end at said planar surface segment of said rearward body portion; and a plurality of elongated jack contact/terminal members formed of conductive material, each jack contact/terminal member including, an intermediate bridging portion extending longitudinally over said recessed planar surface segment from and through a respective one of said openings formed at said forward end region of said recessed planar surface segment to and into an end of a respective one of said bores formed at said rearward end region of said recessed planar surface segment;

a contact portion extending from a forward end of a respective bridging portion through a respective one of said openings and into said plug-receiving receptacle; and a terminal portion extending from a rearward end of a respective bridging portion into and through a respective one of said bores formed through said rearward body portion to project beyond said planar surface of said rearward body portion to define terminal pin portions; and wherein said jack contact/terminal members being in their entirety recessed inwardly within said outer cylindrical boundary envelope.

6. A modular jack as recited in claim 5, wherein a plurality of channels are formed on said recessed planar surface segment, each of said channels extending longitudinally directed between a respective opening formed through said side wall of said forward body portion and a respective one of said bores formed through said rearward body portion at said recessed surface; and wherein a bridging portion of each of said jack contact/terminal members is situated in a respective one of said channels.

7. A modular jack as recited in claim 6, further including means provided on said recessed planar surface for heat staking each of said bridging portions of said jack contact/terminal member to said housing.

8. A modular jack as recited in claim 7, wherein a notch is formed in each of said channels on said recessed planar surface, and wherein said bridging portion of each of said jack contact/terminal members includes an offset segment received in a respective one of said notches.

9. A modular jack as recited in claim 5, wherein a comb structure comprising a plurality of adjacent parallel slots is provided in said plug-receiving receptacle for receiving and guiding respective contact portions of said jack contact/terminal members.

10. A modular jack as recited in claim 5, wherein said planar surface of said rearward body portion terminates at a forward end thereof at a planar rearward end surface segment of said forward body portion.

11. A modular jack as recited in claim 10, wherein said planar surface of said rearward body portion and said planar rearward surface segment of said forward body portion together define a space for receiving a portion of a printed circuit board for connection to said terminal pin portions.

12. A modular jack as recited in claim 5, wherein at least one cavity is formed in said outer partial cylindrical surface segment of said rearward body portion structured and arranged for cooperation with a projecting member formed within said tubular enclosure for locating said jack within said tubular enclosure.

13. A modular jack as recited in claim 5, wherein said jack further includes a grounding contact/terminal member mounted on said housing for an engaging an interior surface of a tubular enclosure when said jack is situated therein.

14. A modular jack as recited in claim 13, wherein said grounding contact/terminal member includes a grounding contact portion, an intermediate grounding bridging portion and a grounding terminal portion, said grounding terminal portion extending from one end of said grounding bridging portion into and through a respective one of said bores formed through said rearward body portion to project beyond said planar surface of said rearward body portion, and said grounding contact portion flexibly extending from another end of said grounding bridging portion and said grounding bridging portion extending longitudinally over said recessed planar surface segment; and wherein said grounding contact portion is situated in a first position outwardly of said outer cylindrical boundary envelope prior to the jack being situated in a tubular enclosure and structured and arranged to engage an interior surface of the tubular enclosure when the jack is situated therein and to flex to a second position situated within said outer cylindrical body envelope upon insertion of the jack into the tubular enclosure.

* * * * *